United States Patent [19]

Trinidad

[11] Patent Number: 4,491,242

[45] Date of Patent: Jan. 1, 1985

[54] NAPKIN HOLDER

[76] Inventor: Maria A. Trinidad, Rte. 2, 10710 W. Pecan Rd., Tolleson, Ariz. 85353

[21] Appl. No.: 446,370

[22] Filed: Dec. 2, 1982

[51] Int. Cl.[3] ..... A47K 10/20

[52] U.S. Cl. ..... 221/312 R; 211/50; 312/37

[58] Field of Search ..... 221/33, 34, 44–48, 221/55, 56, 61, 62, 281–283, 206, 207, 304, 309, 311, 312 R, 312 C, 251; 211/16, 50, 49 D, 49 R; 312/37, 211, 50, 60, 71; 206/494; 248/DIG. 3; 141/369, 358, 108, 109

[56] References Cited

U.S. PATENT DOCUMENTS

| | | | |
|---|---|---|---|
| 1,010,468 | 12/1911 | Weaver | 221/311 X |
| 1,464,180 | 8/1923 | Hudson | 221/48 |
| 3,324,754 | 6/1967 | Peavy | 221/44 X |

*Primary Examiner*—Charles A. Marmor

*Attorney, Agent, or Firm*—Drummond & Nissle

[57] ABSTRACT

An improved napkin dispenser. The dispenser includes an upright container having a napkin dispensing mouth shaped, contoured and dimensioned such that an empty tabletop napkin holder can be inserted into the napkin dispensing mouth and filled with a fresh supply of napkins.

2 Claims, 5 Drawing Figures

NAPKIN HOLDER

This invention relates to napkin storage and dispensing devices.

More particularly, the invention relates to a napkin holder adapted to dispense napkins individually or in stacks containing a selected number of napkins, the stacks of napkins being sized to readily fill conventional tabletop napkin holders.

In another respect, the invention relates to a napkin holder which can be readily adapted to receive and store napkins of differing shape, contour and dimension.

In a further respect, the invention relates to a wall mounted napkin holder which includes a napkin dispensing opening shaped and dimensioned such that at least a portion of an empty conventional tabletop napkin holder can be inserted through the dispensing opening of the wall mounted holder in order to fill the tabletop holder with napkins.

Napkin holders of the type shown in U.S. Pat. No. 1,702,983 to Shaffer et al are well known in the art. One problem associated with the Shaffer napkin holder occurs while the holder is being filled with a supply of napkins. If the stack of napkins being inserted in the holder is more than one or two inches high, the corners or edges of some of the napkins tend to turn under or be ruffled when the napkins are dropped into the holder. The rumpling of napkins when they are inserted in the Shaffer holder cannot be controlled because an individual cannot readily position one hand beneath or along one side or corner of the stack of napkins to slowly guide the napkins into the holder. Consequently, air escaping from the holder when a stack of napkins is dropped in the holder tends to catch the edges and corners of at least some of the napkins and to cause individual napkins to shift out of their stacked relationship with the other napkins. Since table napkins are usually not interleaved as are hand towels dispensed from wall racks in restrooms, individual napkins in a stack of napkins are more easily displaced with respect to one another when the stack of napkins is dropped into the holder depicted in Shaffer et al.

Another problem associated with conventional napkin dispensers such as the dispenser pictured in Shaffer is that when an individual wishes to remove from the dispenser a stack of napkins sufficient to fill a smaller sized conventional tabletop napkin holder it is difficult to guage the proper number of napkins which should be removed to fill the tabletop holder. Often too many napkins are removed and must be forced into the tabletop holder. If too many napkins are forced into the tabletop holder, all of the napkins tend to be pulled from the holder at once when an attempt is made to remove a single napkin from the holder.

A further limitation of the Shaffer napkin holder is that it will, practically speaking, only receive one size of napkin.

Finally, if only a few napkins remain in the Shaffer holder, removing a napkin from the holder is awkward since notch 19 does not extend down to the floor of the holder.

Accordingly, it would be highly desirable to provide an improved napkin holder in which a large number of napkins could be quickly and conveniently inserted without having the edges of individual napkins being ruffled or moved out of their orderly relationship with other napkins in the stack.

It would also be desirable to provide an improved napkin holder in which a stack of napkins could be inserted such that either single napkins or stacks of napkins could be readily removed from the holder.

It would further be desirable to provide an improved wall mounted napkin holder having a napkin dispensing mouth shaped and dimensioned such that a conventional table napkin holder could be quickly inserted in the dispensing mouth and filled with napkins from the wall mounted holder.

Therefore, it is a principal object of the invention to provide an improved napkin holder and dispenser.

Another object of the instant invention is to provide an improved napkin holder in which a large stack of napkins can be readily inserted without ruffling or displacing the edges or corners of individual napkins with respect to other napkins in the stack.

A further object of the invention is to provide a napkin holder having a dispensing mouth through which single napkins or groups of napkins can be readily removed from the holder, the dispensing mouth being constructed such that a stack of napkins of the size necessary to fill a conventional tabletop napkin holder can be readily removed therefrom.

Still another object of the instant invention is to provide an improved napkin holder having a napkin dispensing mouth shaped and dimensioned such that an empty tabletop napkin holder may be readily inserted in the dispensing mouth to withdraw the number of napkins necessary to fill the table holder.

Yet another object of the invention is to provide an improved napkin holder which can be readily modified to receive, store and dispense napkins of differing size.

These and other, further and more specific objects and advantages of the invention will be apparent to those skilled in the art from the following detailed description thereof, taken in conjunction with the drawings, in which.

Figure 1:
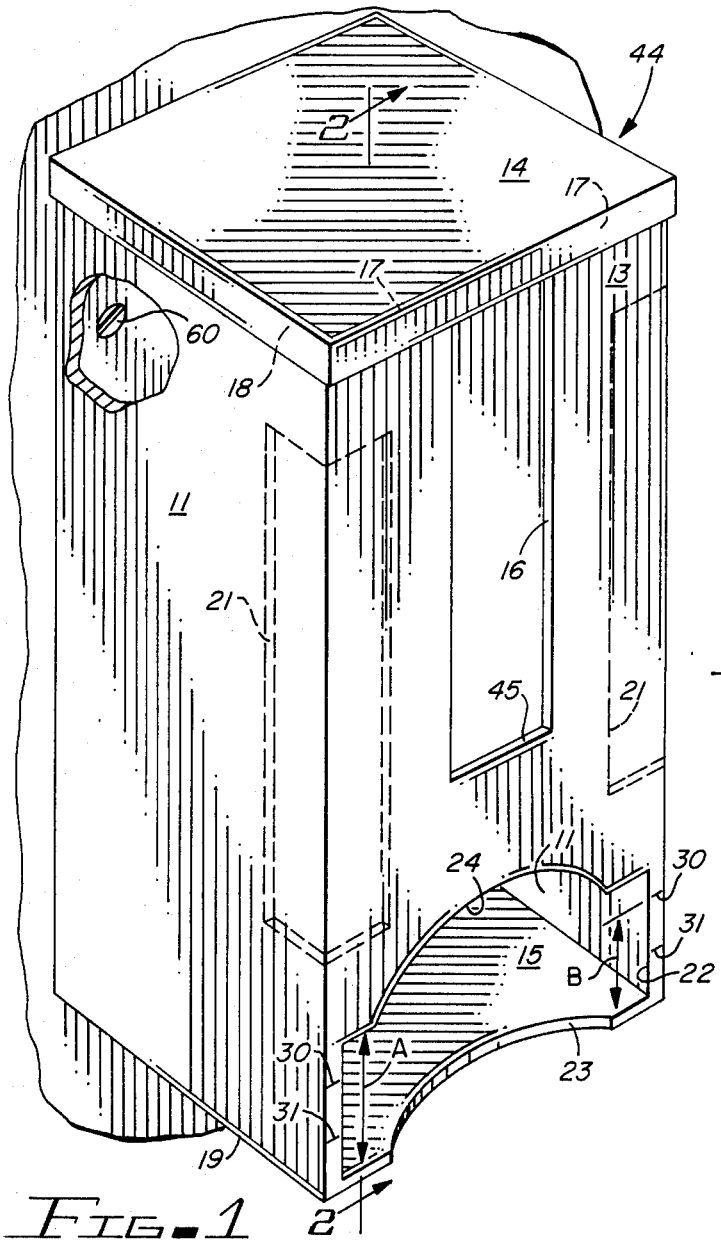
FIG. 1 is a perspective view of a napkin holder constructed in accordance with the principles of the invention.
Figure 2:
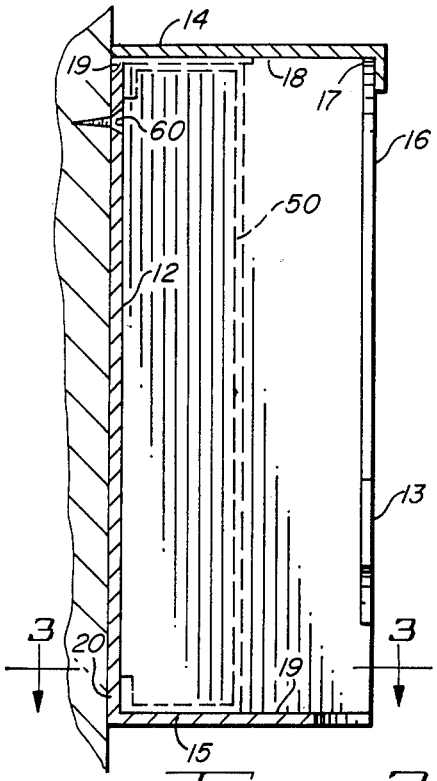
FIG. 2 is a side sectional view of the napkin holder and dispenser of FIG. 1 taken along section line 2—2 thereof.

Briefly, in accordance with my invention, I provide an improved napkin storage and dispensing device. The device comprises an upstanding container having front, side and back walls each having upper and lower edges and an inner surface, the upper edges of the walls peripherally defining an opening through which napkins can be inserted in the container, the lower edges of the back and side walls being generally attached to a floor panel, the inner surface of the walls being shaped, contoured and dimensioned to receive and maintain in position an upright stack of napkins inserted through said top opening into said container; a napkin dispensing opening between said floor panel and at least one of the lower edges of the front wall, the opening being shaped and dimensioned such that an individual can readily remove therethrough a stack of napkins having a predetermined height; and a notch formed in the floor of the container such that an individual may touch the underside of the bottom napkin of the stack in the container while permitting the bottom napkin to remain in fixed position with respect to the container, the notch permitting a single napkin dispensing opening. At least one of the walls of the container includes a vertically disposed aperture formed therethrough such that when a stack of napkins is being inserted in the container, an individual can maintain manual contact with the bottom of the stack.

The improved napkin holder can have the opening between the floor panel and the lower edge of the front wall shaped, contoured and dimensioned such that an empty tabletop napkin holder may be inserted therethrough and filled with napkins from the container, the tabletop napkin holder including a pair of upstanding, opposed walls attached to a base, each of the upstanding, opposed walls having an upper leading edge.

The notch formed in the floor of the napkin holder can be shaped and dimensioned such that the leading edge of at least one of the opposed walls of the tabletop napkin holder can be inserted in the notch beneath the underside of the bottom napkin in the container and be upwardly displaced to lift the stack of napkins away from the floor of the container.

Turning now to the drawings, which depict the presently preferred embodiments of the invention for the purpose of illustrating the practice thereof and not by way of limitation of the scope of the invention and in which like reference characters represent corresponding elements throughout the several views, FIGS. 1 to 4 illustrate a napkin holder constructed in accordance with the principles of the invention and including side walls 11, back wall 12, front wall 13, removable lid 14, and floor panel 15. Vertical notch 16 is formed through front wall 13 so that an individual can manually maintain contact with a stack of napkins being inserted in the napkin holder and slowly lower the napkins into the holder so that the edges of the napkins will not be ruffled.

Upper edges 17 of front wall 13, 18 of side walls 11, and 19 of back wall 12 peripherally define the upper opening through which a stack of napkins is lowered into the holder. Lower edges 19 of side walls 11 and 20 of rear wall 12 are attached to floor panel 15. Lower edges of front wall 13 may, depending on the construction of the napkin holder, also be attached to floor 15. As indicated by dashed lines 21, vertical apertures may be formed in the corners between the side walls 11 and front wall 13. Since napkin corners tend to be more easily ruffled than the peripheral elongate edges of the napkins, vertical slots 21 would enable an individual to use his fingers to control the corners of a stack of napkins being lowered into the napkin holder and to further minimize ruffling of individual napkins in the stack.

Dispensing mouth 22 of the napkin holder includes semicircular notch 23 formed in floor panel 15 and notch 24 formed in the bottom portion of front wall 16. As indicated in FIG. 4, notch 23 permits the index finger 25 of an individual to be positioned on the underside of the napkin on the bottom of stack 27 while notch 24 permits thumb 28 to be readily placed above the top napkin on a stack of napkins having a height equivalent to that indicated by arrow A in FIG. 1. Dashes 30 and 31 indicate the number of napkins which should be removed through mouth 22 in order to fill conventional tabletop napkin holders. In particular, a stack of napkins having the height indicated by dashes 30 and arrow B in FIG. 1 would fill conventional tabletop holder 32 shown in FIGS. 3A and 3B.

Tabletop napkin holder 32 includes a pair of spaced, semicircular, opposed, generally parallel panel walls 41 (not visible in FIGS. 3A, 3B) and 40 attached to a rectangular base 42. Each semicircular wall has a leading edge 43 which defines the top of the napkin holder when the holder is set on its base 42. As indicated in FIG. 3A, the width C of mouth 22 is larger than the width D of tabletop napkin holder 32 so that holder 32 can be slid through mouth 22 into the wall mounted holder shown in FIGS. 1–4 and generally indicated by reference character 44.

In use, after lid 14 is removed from holder 44, a stack of napkins is grasped by an individual and held with one hand on the bottom and the other hand on the top or side of the stack. The stack of napkins is gradually lowered into holder 44 through the top opening thereof with the fingers of the hand on the bottom of the stack of napkins extending through notch 16 while the stack is lowered into holder 44. When the bottom of the stack reaches the bottom 45 of notch 16, the fingers of the hand which was holding the top of the stack of napkins can usually be inserted through mouth 22 to engage the bottom of the stack of napkins and guide the napkins downwardly until the bottom of the stack contacts floor 15.

Figure 3A:
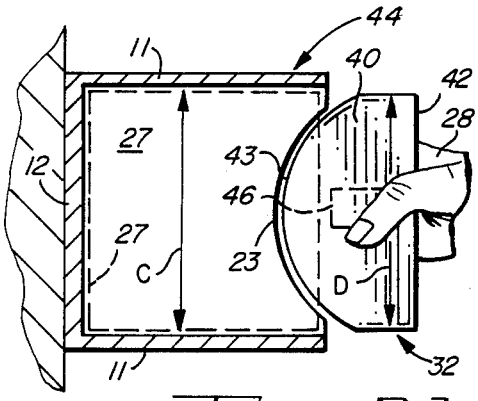
FIG. 3A is a top sectional view of the napkin holder and dispenser of FIG. 2 taken along section line 3—3 thereof and illustrating the mode of operation thereof.
Figure 4:
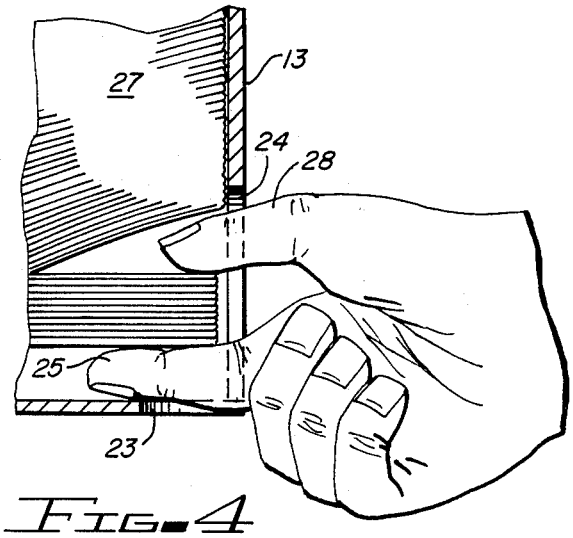
FIG. 4 is a side sectional view of the napkin holder of FIG. 1 illustrating the mode of operation thereof.
Figure 3B:
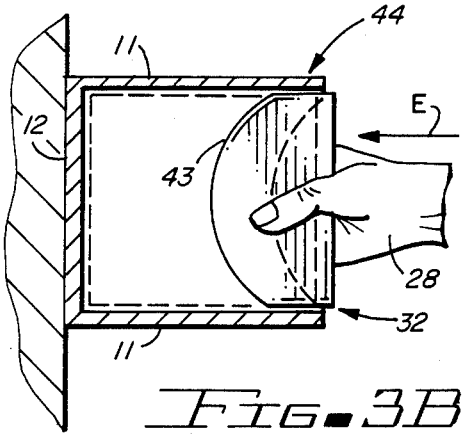
FIG. 3B is a top sectional view of the napkin holder and dispenser of FIG. 2 taken along section line 3—3 thereof and further illustrating the mode of operation thereof.

In order to fill empty tabletop holder 32 as pictured in FIGS. 3A and 3B, holder 32 is grasped as pictured in FIGS. 3A and 3B and tipped so that leading edge 43 of top panel 40 is slightly higher than the line along which panel 40 contacts base 42. Leading edge 43 of lower wall 41 is inserted in slot 23 as shown in FIG. 3A and holder 32 lifted upwardly so that wall 41 will slide between the bottom of stack 27 and floor 23. Holder 32 is then pushed in the direction of arrow E to the position shown in FIG. 3B. In one embodiment of the invention, walls 40, 41 are resilient so that when holder 32 reaches the position shown in FIG. 3B, walls 40 and 41 can be squeezed toward one another to maintain napkins in holder 32 as holder 32 is withdrawn from container 44. A similar effect could be obtained by cutting notch 46 through upper wall 40 in FIG. 3A. Notch 46 would permit an individual's thumb 28 to press napkins downwardly against wall 41 when holder 32 was in the position shown in FIG. 3B. With thumb 28 pressing napkins in holder 32 downwardly against wall 41, holder 32 could be withdrawn from container 44. A notch could also be formed through wall 41 so one of the fingers of an individual's hand could upwardly press napkins against wall 40 or thumb 28 when holder 32 was in the position shown in FIG. 3B.

Notch 23 and the leading edges 43 of tabletop napkin holder 32 can be shaped in any manner desired as long as at least one of the leading edges 43 of holder 32 can be inserted in notch 23 so that at least the portion of the bottom of the stack of napkins near or over notch 23 can be upwardly lifted to allow one of walls 40, 41 to be pushed into container 44 between floor 15 and stack 27.

In order to modify container 44 so that it will accept a stack of napkins having a rectangular shape, an insert 50 (FIG. 2) can be provided with container 44. Insert 50 is rectangular and occupies approximately one half of the space within walls 11, 12, 13. Container 44 could be provided with inserts other than insert 50 which would permit round napkins, heart shaped napkins, etc. to be inserted in carrier 44. Depending on the shape of napkin to be stored in container 44, notch 16 could be formed in one or both of side walls 11.

Container 44 may be secured to a wall or other support surface with screws 60 or other attachment means, or be freestanding with legs attached to and downwardly projecting from floor 15.

Having described my invention in such terms as to enable those skilled in the art to understand and practice it, and having identified the presently preferred embodiments and best mode thereof, I claim:

1. In combination with a tabletop napkin holder including a base, a pair of upstanding, opposed walls attached to said base, each of said upstanding, opposed walls having an upper leading edge, an upstanding napkin container, said container including (a) front, side and back walls each having upper and lower edges and an inner surface, said upper edges of said walls peripherally defining an opening through which napkins can be inserted in said container, said lower edges of said back and side walls generally being attached to a floor panel, said inner surfaces of said walls being shaped, contoured and dimensioned to receive and maintain in position an upright stack of napkins inserted through said top opening into said container;

(b) a napkin dispensing opening located between said floor panel and at least one of said lower edges of said front wall, said opening being shaped and dimensioned such that an individual can readily remove therethrough a stack of napkins having a predetermined height; and (c) a notch formed to said floor of said container such that an individual may touch the underside of the bottom napkin of said stack in said container while permitting said bottom napkin to remain in fixed position with respect to said container, said notch permitting a single napkin to be readily withdrawn from said container through said napkin dispensing opening;

at least one of said walls including a vertically disposed aperture formed therethrough such that when said individual inserts said stack of napkins in said container said individual can maintain manual contact with the bottom of said stack while said stack is being inserted in said container, said opening between said floor panel and front wall being shaped, contoured and dimensioned such that said tabletop napkin holder can, when empty, be inserted therethrough and filled with napkins from said container.

2. The combination of claim 1 wherein said notch in said floor is shaped and dimensioned such that the leading edge of at least one of said opposed walls of said tabletop napkin holder can be inserted in said notch beneath said underside of said bottom napkin in said container and upwardly displaced to lift said stack of napkins away from said floor.

* * * * *